US009423124B2

(12) United States Patent
Barudi

(10) Patent No.: US 9,423,124 B2
(45) Date of Patent: Aug. 23, 2016

(54) FEED AND BURNER CONTROL SYSTEM

(71) Applicant: DURAFLAME, INC., Stockton, CA (US)

(72) Inventor: Samir Barudi, Huntington Beach, CA (US)

(73) Assignee: DURAFLAME, INC., Stockton, CA (US)

( * ) Notice: Subject to any disclaimer, the term of this patent is extended or adjusted under 35 U.S.C. 154(b) by 434 days.

(21) Appl. No.: 13/789,552

(22) Filed: Mar. 7, 2013

(65) Prior Publication Data

US 2014/0255857 A1 Sep. 11, 2014

(51) Int. Cl.

| | |
|---|---|
| ***F23D 3/00*** | (2006.01) |
| ***F23D 3/18*** | (2006.01) |
| ***F23N 1/00*** | (2006.01) |
| ***F23D 3/40*** | (2006.01) |
| ***F23D 5/00*** | (2006.01) |
| ***F23D 5/14*** | (2006.01) |

(52) U.S. Cl.

CPC .. *F23D 3/18* (2013.01); *F23D 3/40* (2013.01); *F23D 5/00* (2013.01); *F23D 5/14* (2013.01); *F23N 1/005* (2013.01)

(58) Field of Classification Search

CPC ..... F23D 2206/0057; F23D 5/04; F23N 2035/16; F24C 5/00; F24C 5/02; F24C 5/04; F24C 5/18

USPC ..... 126/500, 502, 503, 512; 431/126, 125

See application file for complete search history.

(56) References Cited

U.S. PATENT DOCUMENTS

| | | | | |
|---|---|---|---|---|
| 2,055,462 | A * | 9/1936 | Baker | F23D 3/00 431/196 |
| 3,817,686 | A * | 6/1974 | Quittner | 431/125 |
| 4,582,478 | A | 4/1986 | Hilker | |
| 5,769,623 | A * | 6/1998 | Lake et al. | 431/125 |
| 5,890,485 | A * | 4/1999 | Shimek et al. | 126/512 |
| 6,527,003 | B1 | 3/2003 | Webster | |
| 6,805,163 | B2 | 10/2004 | Lee | |
| 8,823,714 | B1 * | 9/2014 | Thielvoldt et al. | 345/473 |
| 2003/0106549 | A1 | 6/2003 | Atemboski | |
| 2006/0188832 | A1 | 8/2006 | McCarren | |
| 2007/0235020 | A1 * | 10/2007 | Hills et al. | 126/512 |
| 2012/0282559 | A1 | 11/2012 | Barudi | |
| 2014/0158111 | A1 * | 6/2014 | Zhou | 126/512 |
| 2015/0047627 | A1 * | 2/2015 | Thielvoldt et al. | 126/503 |

FOREIGN PATENT DOCUMENTS

| | | | |
|---|---|---|---|
| CN | 201724274 U | * | 1/2011 |
| JP | 2002-276929 | | 9/2002 |

OTHER PUBLICATIONS

CN 201724274 U—English machine translation.*

* cited by examiner

*Primary Examiner* — Jorge Pereiro

(74) *Attorney, Agent, or Firm* — Koppel, Patrick, Heybl & Philpott

(57) ABSTRACT

A fire display assembly has a burner tray with a porous non-combustible material located in the burner tray positioned adjacent, on or in a non-combustible structure. A source of a combustible liquid positioned a distance from the burner tray is provided with conduits for flowing liquid fuel between the sources and trays. The conduits can include an adjustable valve to control the amount of fluid flowing therethrough. The valves can be preprogrammed to provide a preset flow over time or controlled from a remote location by a flow controller. Ignited fuel from the porous non-combustible material provides the appearance of a burning surface on the non-combustible structure. The arrangement provides a continuous but variable feed of fuel to the porous non-combustible material and allows the fuel feed rate to be varied to provide a variable flame height or to vary the location of the flame in a controlled manner.

15 Claims, 11 Drawing Sheets

FEED AND BURNER CONTROL SYSTEM

BACKGROUND

The invention relates to liquid fuel indoor and outdoor fire displays, particularly burner assemblies configured to burn a liquid fuel, such as an alcohol, paraffinic oils, plant oils, and combustible petroleum or other combustible natural products, either in a liquid or gel form.

Historically, alcohol burning hearth products (fireplaces, stoves, log sets, vessels for containing open flames) and other flame displays such as garden torches, tiki torches, etc. comprise a burner that is filled with alcohol or other liquid fuel, usually a denatured ethanol, or in the alternative, cans of combustible solidified gelled alcohol, or liquid gelled alcohol, that are then lit to create the flame. Depending on the configuration of the burner and the size of the fuel reservoir, once ignited the fuel will burn until consumed, generally for 1-4 hours. Some burner configurations include a damper that will allow the flame to be extinguished prior to full consumption by covering the flame and restricting access to air. To extend the burning time the user typically has to wait until the fuel has burned completely, or the flame is extinguished, and the burner has cooled down before adding more combustible liquid or a replacement can of gelled fuel into the burner and lighting it again. This procedure presents a number of problems which include:

a) The possibility of spilling a highly volatile and combustible fluid on the fireplace or stove assembly and log set, which presents the possibility of unintended combustion thus creating an unsafe situation;

b) Spilling the fuel on a person's arm, clothing or on the floor which can also create a fire hazard;

c) Because the fuels are highly volatile, and it is the vapors off the fuel and not the liquid fuel itself that is burning, these vapors present a very serious risk of accidental ignition. This hazard requires the user to wait for the flame to extinguish and the burner to cool down before refueling to prevent vaporized fuel from igniting during the filling process and a flame possibly propagating back to the container of fluid from which the fuel is being poured, thus creating a very hazardous situation where the fumes in the container are burning and burning fuel is ejected out of a container, thus acting like a flame thrower;

d) Additionally, ethanol, unless specifically blended with additives to provide a visible flame, tends to burn with a nearly invisible color, especially in well-lit areas, causing spills to be very dangerous since it is sometimes impossible to notice that the fuel has ignited. Certain burner assemblies are designed to create yellower flames that are more visible, especially after the fuel has been ignited for some time; the conditions that make the flame visible in the burner assembly do not exist to allow visualization of burning fuel spills; and e) The fuel level inside the burner of an ethanol burning assembly is constantly changing as the fuel is consumed and thus is not always at an optimum level for aesthetics or for clean combustion of the fuel.

These liquid fuel burners in many instances are used as unvented appliances in unvented spaces. As a result, the emissions from combustion end up in the room. Thus clean and complete combustion is very important. An improperly designed or operated liquid fuel burner, or the use of the wrong liquid fuel, releases fuel vapors and carbon monoxide into the room. As a result, consumers have been reluctant to use the currently available ethanol burners.

One product provides for pouring fuel into a reservoir that is then slid into the fireplace assembly from outside the burner assembly. However, this design still requires pouring the fuel from an open bottle, allows for the release of combustible vapors and does not safely allow additional fuel to be added while the fuel is burning.

Significant improvements on such liquid fuel burning systems are shown in U.S. patent application Ser. No. 13/426,516 filed Mar. 21, 2012 which is a continuation-in-part of U.S. patent application Ser. No. 13/102,857, filed May 6, 2011, both of which are incorporated by reference herein in their entirety.

SUMMARY

Disclosed herein is a control system to limit the flow of fuel to a burner or more than one burner in a multi-burner system. Preferably, the porous, non-combustible filler is included in the burner, the porous filler acting as a wicking agent for the liquid fuel. This arrangement allows the user to reduce or increase the fuel feed rate to the burner, which in turn reduces the fuel that wicks into the porous filler, thus allowing control of the level of a flame from combustible fumes emanating from the porous filler without negatively effecting the quality of the flame display. Embodiments of the device disclosed herein provide valving devices within the one or more of the liquid fuel feed lines so as to provide an operator the ability to adjust the fuel feed to each burner, flame display and/or log within the system. The valving can also be attached to a control system that allows the fuel feed to be programmed in a set sequence of on or off or to provide a randomly variable fuel feed so as to provide lesser or greater fuel feed at any desired time which in turn provides a variable height flame display.

DETAILED DESCRIPTION

Disclosed herein are arrangements for controlling the feed of a liquid fuel to indoor and outdoor fire displays. The arrangements are particularly suited to the delivery of alcohol based liquid fuels, particularly methanol, ethanol, propanol, butanol, etc. or mixtures of such fuels, but are not so limited. Other liquid fuels can be used such as ester oils, plant oils, paraffinic compositions, and combustible petroleum or bio-sourced combustible products, either in a liquid or gel form. The fire displays may be in a fireplace or stove or free standing such as a fire pit or decorative flame display with or without artificial firelogs. As alternatives, the fire displays can include non-combustible artificial logs or various non-combustible media to enhance the decorative appearance of the fire display, such as glass beads, chunks or shards, stones, metal sculptures, water features, etc and various combinations thereof. The disclosure herein is directed to various arrangements for varying but continuously providing the liquid fuel to porous, non-combustible material adjacent to, or located within, the logs or decorative materials which constitute the fire display. While "combustible" and "flammable" have different definitions, "combustible" materials as used herein is intended to include "flammable" materials.

Figure 1:
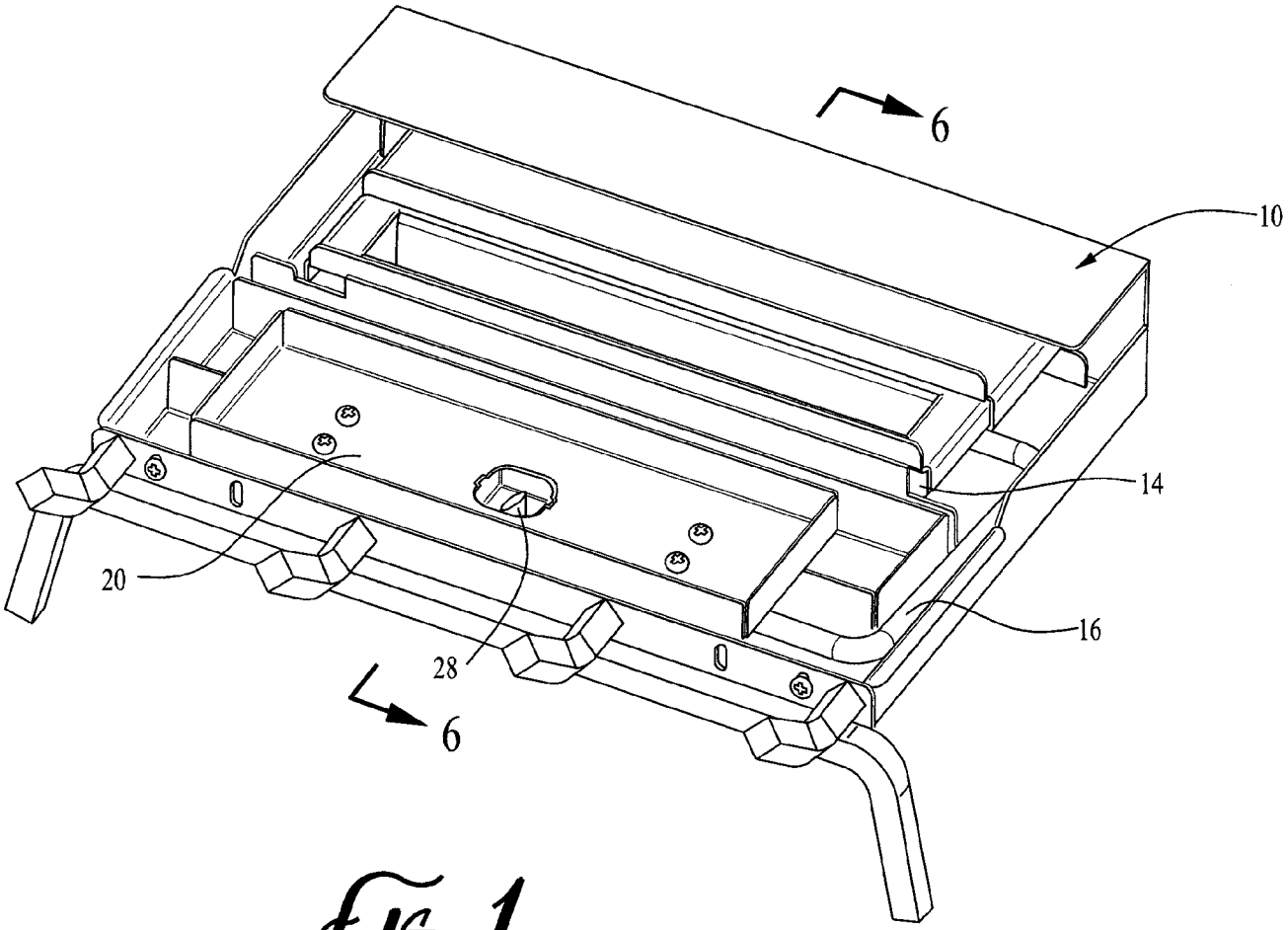
Fig. 1 PRIOR ART
FIG. 1 is a front perspective schematic view of a first embodiment of a prior art liquid fuel burner assembly suitable for incorporating features of the invention therein or therewith.
Figure 2:
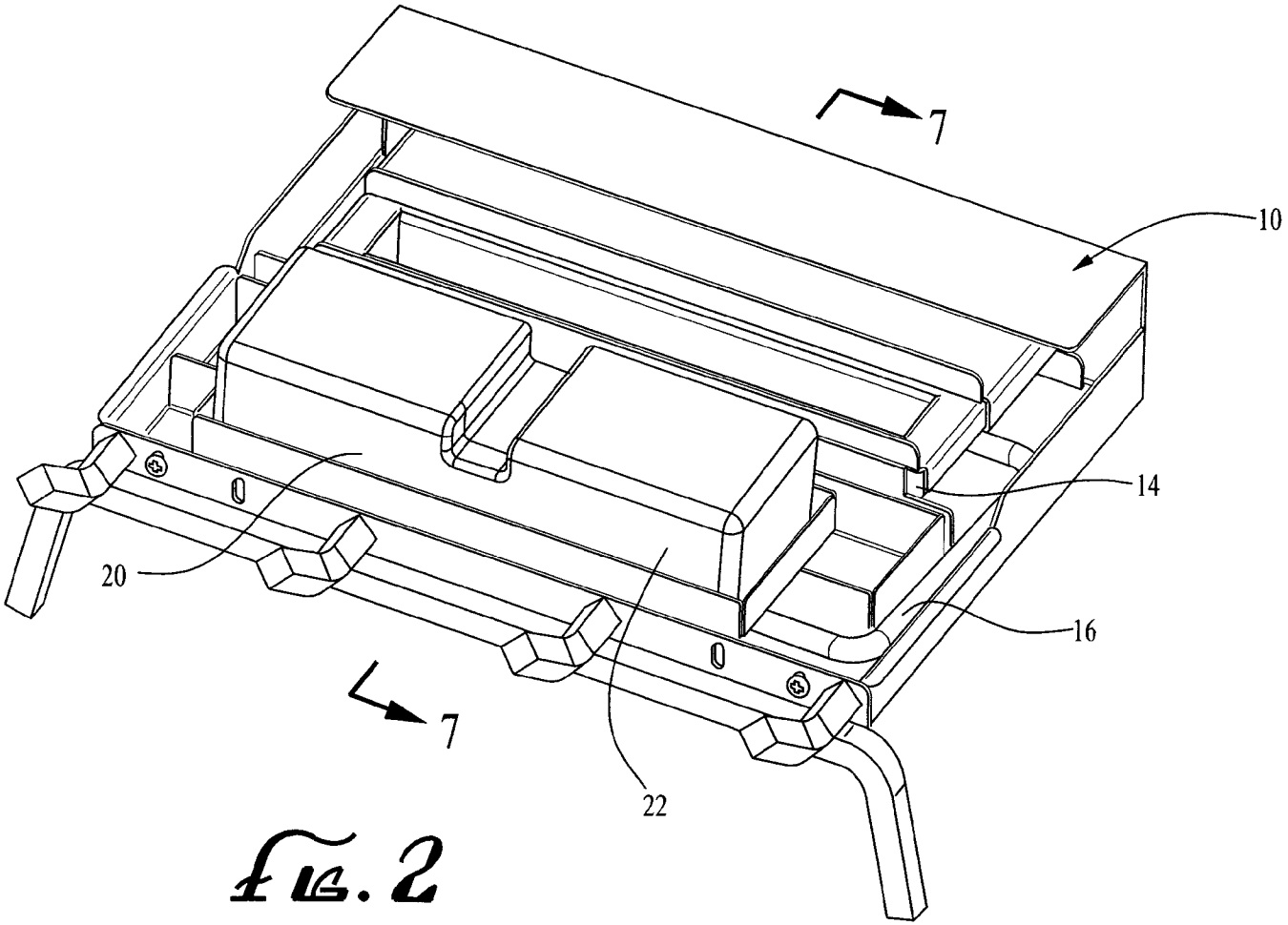
FIG. 2 PRIOR ART
FIG. 2 is a front perspective schematic view of the liquid fuel burner assembly of FIG. 1 including a fuel delivery bottle.
Figure 3:
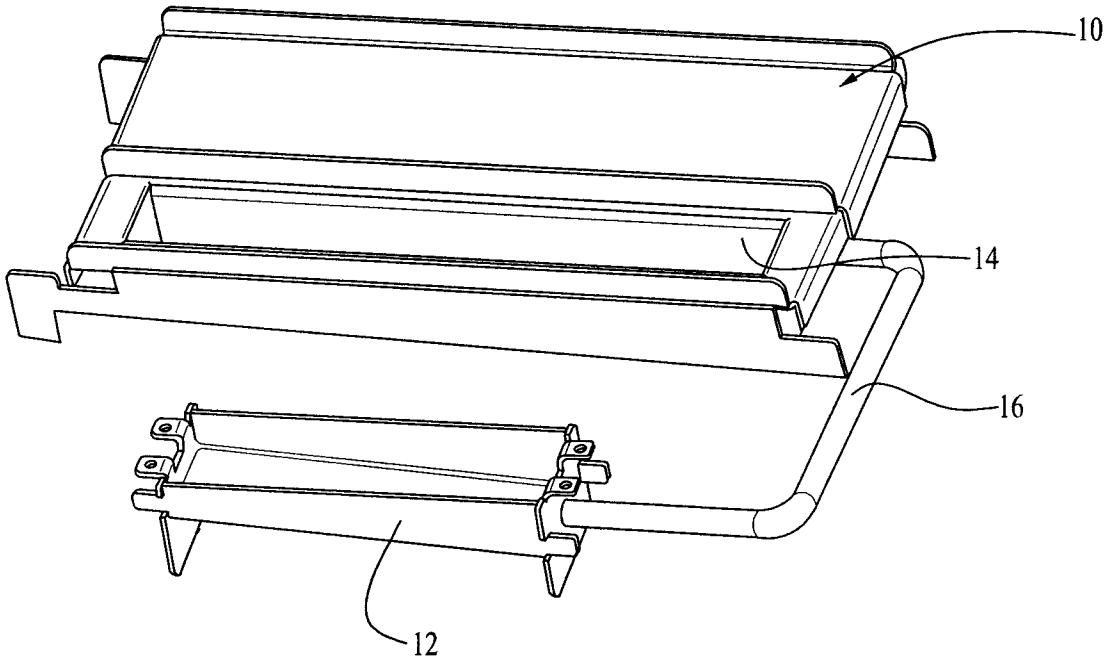
FIG. 3 PRIOR ART
FIG. 3 is a front perspective schematic view of the burner and fuel reservoir portions of FIG. 1.

Referring to FIGS. 1-4, and as best shown in FIG. 3, a prior art liquid fuel burner assembly 10 includes a fuel receiving reservoir 12, a burner 14 connected to the fuel receiving reservoir 12 by a conduit, preferably a tube 16 or other closed conduit and a bottle receiving tray 20. While a structure referred to as a "tray" is shown, the tray merely identifies a location for placement of the bottle and a physical structure such as a tray is not necessary. A bottle 22 for containing the liquid fuel 24 is designed to be placed on the bottle receiving tray 20. The term "bottle" is used to indicate any container for the liquid fuel and it is not intended to limit the disclosure to a glass or plastic container. The assembly may include a piercing implement 28 as shown in or other suitable bottle openers so that when a sealed bottle 22 is placed on the tray 20 the liquid fuel pours out of the bottle 22 and into the fuel receiving reservoir 12.

Figure 4:
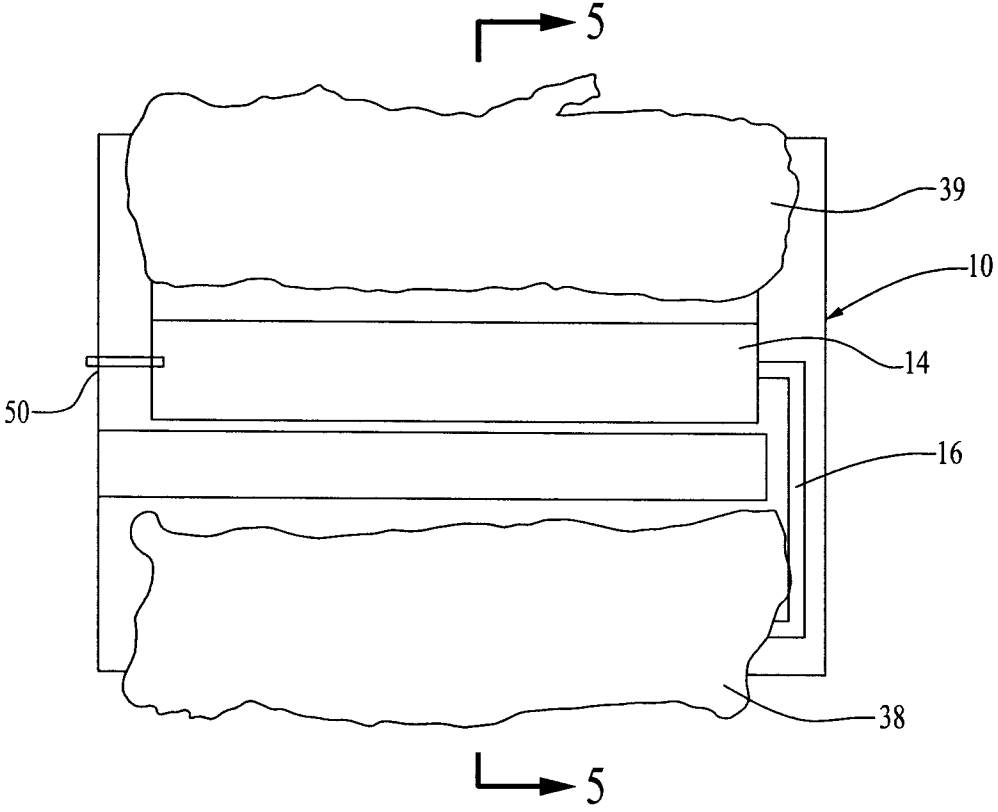
FIG. 4 PRIOR ART
FIG. 4 is a top schematic view of the liquid fuel burner assembly of FIG. 1 with artificial logs placed on top of the burner and fuel reservoir assembly.
Figure 5:
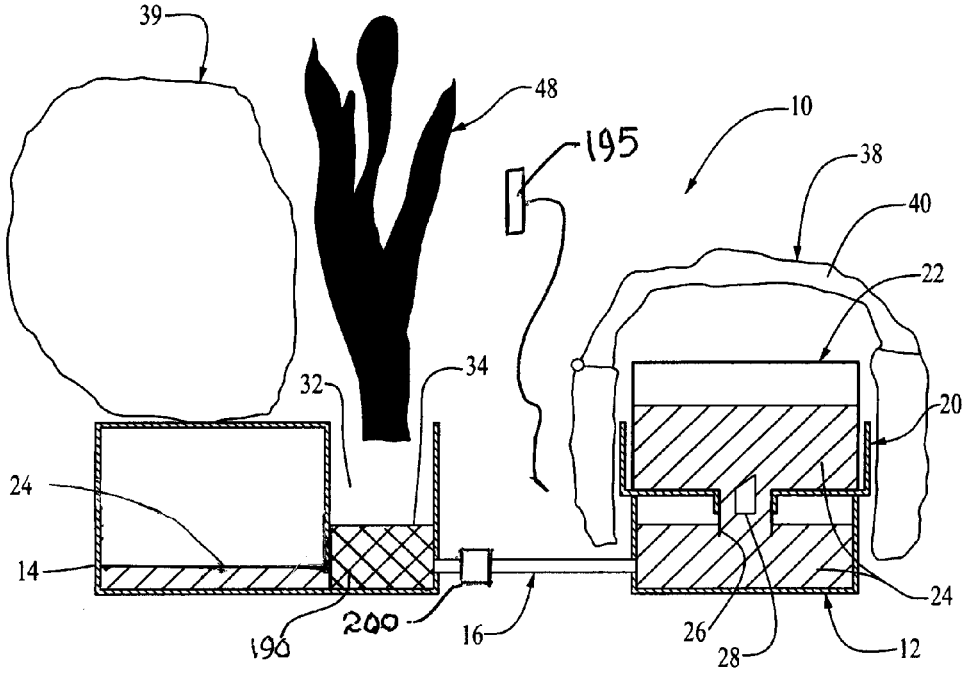
FIG. 5 is a left end schematic sectional view taken along line 5-5 of FIG. 4 showing the liquid fuel burner assembly of FIG. 1 incorporating features of the current invention in operation.

FIG. 4 is a top view of the liquid fuel burner assembly 10 of FIGS. 1-3 with artificial logs 38, 39, preferably constructed of a ceramic material or other non-combustible material, formed to resemble real wooden logs. As best shown in FIG. 4, the burner 14, which may comprise one or more compartments, is positioned to provide a burning area between the rear log 38 and the front log 39. When the vapor 32 over the liquid fuel 24 is ignited to produce a flame 48 (as shown in FIG. 5), as described below, the assembly appears to an observer as if it is a natural log fire. The burner can be positioned in any location desired in relation to the logs; as an example, it can comprise only one log behind, in front of it or to the side of the burner, or not have any logs next to or around the burner.

FIG. 5 is a cross sectional view taken along line 5-5 of FIG. 4, providing a schematic representation of a liquid fuel burner assembly 10 incorporating a fuel flow control mechanism, for simplicity referred to as a valve 200, and a control device 210. A flame 48 is shown emanating from vapors above the fuel 24 residing in the burner 14 at a location between the front and rear artificial logs 38, 39. One skilled in the art will recognize that while the disclosed embodiment shows two artificial logs, it is contemplated that more one or more logs 38,39 and burners 30 can be used to provide a larger appearing flame. In a preferred arrangement the burner 14 is at least partially filled with a non-porous material 190 which acts as a wick to move the fuel from the burner 14 and to provide an evaporative surface for the fuel vapors. Examples of suitable porous materials 190 include but are not limited to porous ceramics, sintered metal structures, metal foams, rigid aggregates of one or more of quartz, sand or silica and certain porous high temperature polymers. In cooperation with the fuel control system described herein, this allows less fuel to sit in the burner 14 which in turn provides an ability to restrict the amount of fuel in the porous material 190 by varying the fuel feed and provides lesser fuel which in turn reduces the flame height. Also as shown in FIG. 5, a sensor 195 can be provided to sense the height of the flame and, through a feed-back loop and adjustment of the fluid flow control valve 200, a change in the flame height can be controlled or programmed.

The fuel flow control mechanism 200 may include various different fluid control components, such as valves, which can preferably be controlled either manually or by the preprogramed control device 210 to restrict and vary the flow of fuel through the feed line to the burner 14. This will result in the fuel wicking through the porous material 190 and the fumes emanating therefrom which are ignited to provide a flame display. Reducing the fuel flow to the burner 14 reduces the volume of fuel in the porous material 190 which, in turn will reduce the fumes ignited and the flame size that is observed.

Combustible vapor 32 accumulates above the surface of the liquid fuel in the porous material 190 in a burner 14; once ignited the flame then emanates from the vapor 32 at a distance above the fuel surface 34 as shown in FIG. 5. As the fuel 24 in the burner is consumed by burning of the vapors, the fuel level in the burner 14 begins to drop; however, more fuel can be continuously fed from the bottle 22 and the reservoir 12. This cycle continues until the bottle 22 is empty, at which point another bottle 22 can be placed into the bottle receiving tray 20, thus refilling the burner 14. A bottle of fuel typically containing 0.5 to 2 liters of fuel can be installed in the burner assembly to support a burn for at least about 1-4 hours. However, this time can be extended by use of the valve 200 to reduce the flow as discussed herein. Also, larger or smaller containers can be used and the assembly described herein is not limited by the size of the containers. One skilled in the art will recognize that larger fuel containers can be used and it is not necessary that the fuel source be adjacent to the burner assembly. In fact the fuel source can be located at a distance from the burner, fuel can be delivered with the assistance of a pump and the fuel delivery lines can include the controlled valve delivery system described herein.

Figure 6:
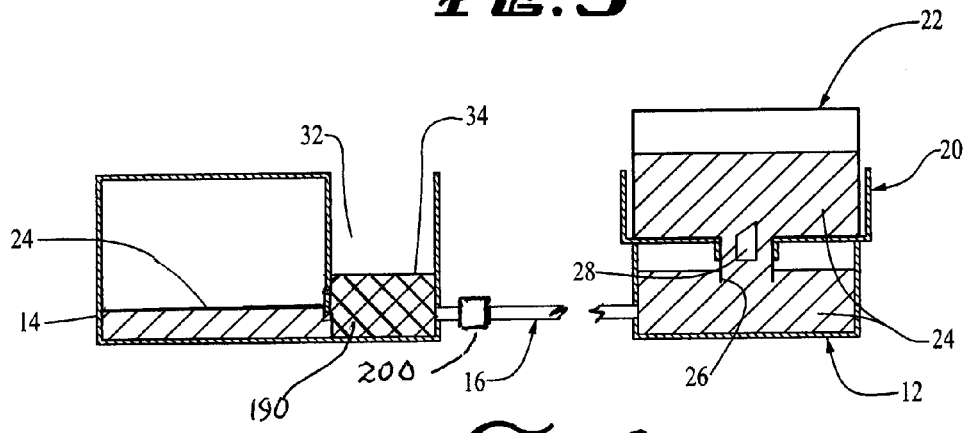
FIG. 6 is a schematic sectional view showing and embodiment comprising a liquid fuel burner and fuel reservoir assembly spaced from the burner with a fuel bottle in place for operation of the burner assembly.

The embodiment of FIGS. 1-5 includes a large burner 14 which is divided into two compartments. However, single compartment burners are also suitable. FIG. 6 schematically illustrates the same fuel feed arrangement but locates the fuel source at a distance, the conduit 16 being sufficient long and having a suitable inner diameter so that the fuel flows readily from the source 22, through the valve 200 to the burner 14. It is recognized that this arrangement may require a pump in the fuel conduit as gravity feed may not be adequate to maintain a proper fuel flow rate.

Figure 7:
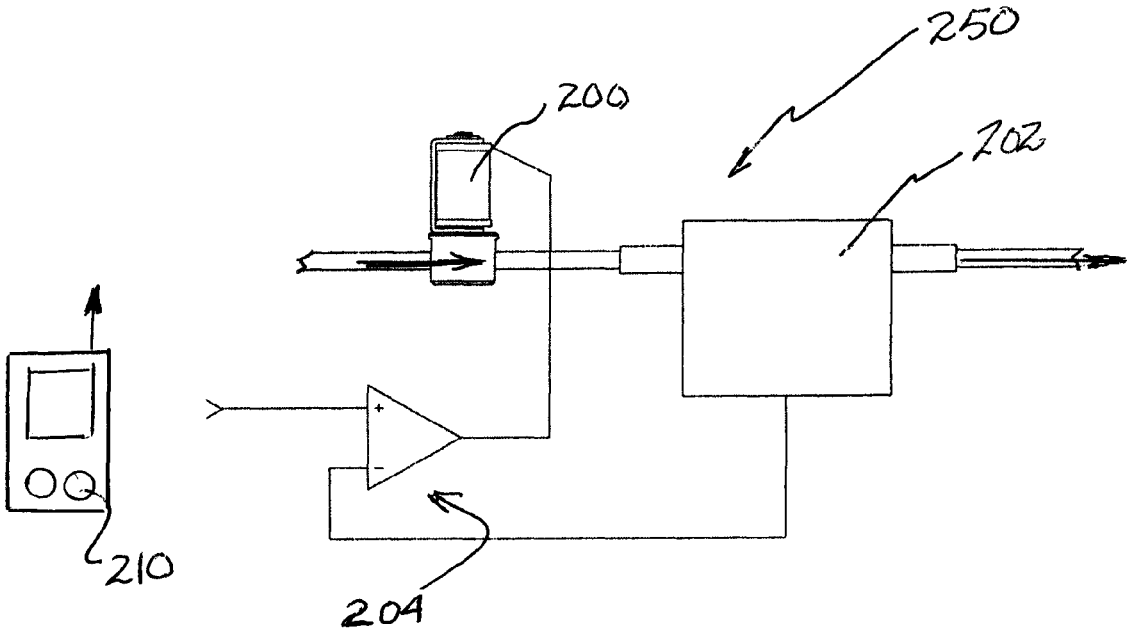
FIG. 7 is a schematic drawing illustrating a portion of FIG. 5 showing the flow control valve positioned in a flow conduit, a flow controller and related electrical connections along with an optional flow sensor.

FIG. 7 schematically illustrates a valve and control system 250 incorporating features of the invention. The valve 200 is shown mounted in a flow conduit 16 with a flow sensor or pressure monitor 202 and a valve driver circuit 204 which can be used to maintain the flow rate through the valve 200 or when in communication with a controller 210 may be used to vary the flow rate manually, in a preprogramed manner, or in a random manner. One skilled in the art will recognize that the flow or pressure sensor 202 and the valve driver circuit 204 can be optional and the controller can be directly wired to the valve or can communicate with the valve through various wireless systems well known to the art.

FIGS. 8-11 show several variations of the system incorporating a fuel source 22 or fuel reservoir 12, a flow control mechanism 200 and a burner 14. While not shown in these figures, each burner 14, in a preferred embodiment, will also include the porous non-combustible material positioned therein.

Figure 8:
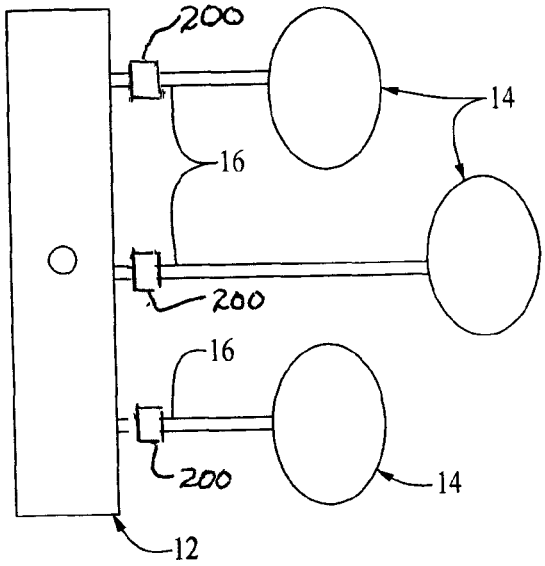
FIGS. 8, 9 and 10 are schematic drawing of second, third and fourth embodiments of the liquid fuel burner assembly including multiple burners incorporating features of the current invention.
Figure 9:
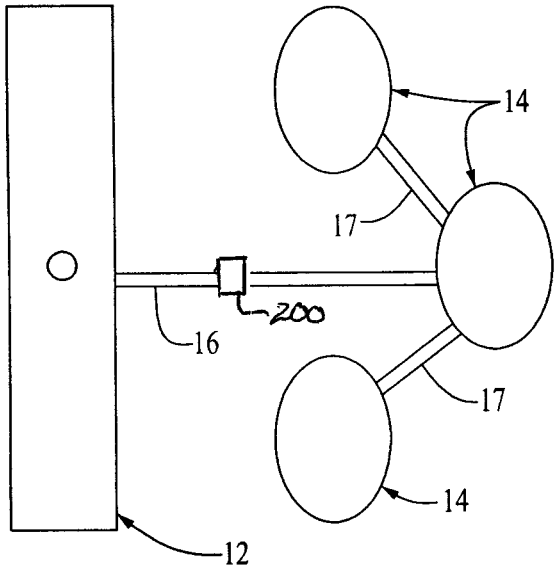
Figure 10:
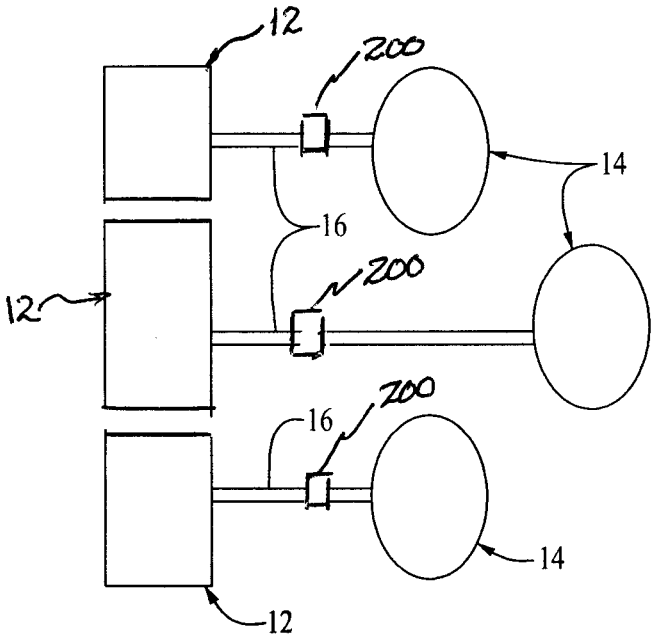

FIGS. 8, 9 and 10 are schematic drawings of second and third embodiments including multiple smaller burners 14 connected to a fuel receiving reservoir 12. Alternatively the fuel reservoir can be replaced by a fuel container 22 to provide a direct feed from the fuel source. However for simplicity of description, reference will be to reservoir 12 as the fuel source. In FIG. 9 three burners 14 are spaced from the fuel reservoir 12, each burner receiving the liquid fuel through a dedicated tube 16 and each tube having a flow control mechanism 200 in communication with a controller 210 (not shown) so that the fuel flow rate to each burner 14 can be varied. The arrangement in FIG. 8 has a single tube 16 attached to the reservoir 14, that tube then being connected to the auxiliary tubes 17 for feeding the individual burners. While not shown, each auxiliary tube 17 tube can also have a valve 200 in communication with a controller. FIG. 10 is a schematic drawings of a fourth embodiments including multiple smaller burners 14 each connected to its own fuel source (reservoir 12) buy a fuel conduit having a flow regulator 200, referred to below as valve 200 in communication with a controller. However, the invention set forth herein is not limited to the embodiments shown and one skilled in the art, based on the teachings herein will recognize that numerous variations with multiple burners, multiple feed tubes, multiple valves and multiple fuel reservoirs can be utilized to move the combustible liquid from the fuel source to the burner and all of these embodiments will allow the use of multiple bottles of liquid fuel. Multiple fuel lines feeding fuel from multiple fuel reservoirs can likewise be used and the flow through each of those fuel lines can be controlled separately or in tandem or some fuel lines can be provided with a flow control 200 so that fuel is fed to at least one burner 14 at all times.

FIG. 7 is a schematic representation of an electrically controlled valve with a solenoid capable of causing variably restricting flow through such a valve. One skilled in the art will recognize that there are numerous remotely controllable valve systems. For example, U.S. Pat. Nos. 6,805,163 and 6,527,003, incorporated herein in their entirety by reference, are merely representative of such variable flow valves and are presented as examples and not intended to limit the scope of the disclosure herein. One skilled in the art will also recognize that mechanically activated, such as clock controlled spring loaded valve systems, or pneumatically controlled variable flow valves are also contemplated within the scope of the present disclosure and that these systems can be connected by tubing or wires connected to a remotely located controller or can be manipulated using free standing remote control systems such as incorporated in audio/visual remote controls or by use of signal transmission from a phone system, such as, for example, a smart phone. Also, while the descriptions herein and the figures show individual valves independent positioned in spaced apart flow lines, one skilled in the art will recognize that the flow lines can be positioned so as to position the multiple valves in a single modular valve assemble for easy of assembly. While not shown, one skilled in the art will further recognize that the flow control system can also include a pump located between the fuel source and the valve 200 or the valve 200 can be replaced by a variable speed pump which can also be programmed to deliver a controlled but variable flow rate to the burner. In such instance, the flow regulator schematically 200 in the figures, referred to herein as a valve 200, shall be alternatively interpreted as pump 200.

The embodiments shown in the FIGS. 1-5 allow for placement of the fuel bottle and fuel receiving reservoir in the liquid fuel burner assembly 10 but at a location where it is also protected from the heat of the flame. The remaining figures allow for the same placement of the fuel source or, in the alternative, by extension of the fuel line the fuel source can be in a location spaced from or even remote from the burner tray or flame display. FIG. 6 shows the fuel line to be broken to represent that said fuel line is extended and the fuel source is located at a distance.

While embodiments disclosed herein describe a device and method for providing a variable but controlled continuously burning flame in a fireplace enclosure, including artificial logs, one skilled in the art will recognize that the assembly of various components and their method of use is not restricted to placement within an enclosure and can be readily adapted to use in fire pits and decorative flame display arrangements both indoors and outdoors. In addition, the use of logs is not necessary and could be replaced by many items like rocks, glass, coal beds, etc. For example, FIGS. 11 and 12 illustrate alternative embodiments including multiple burners.

Figure 11:
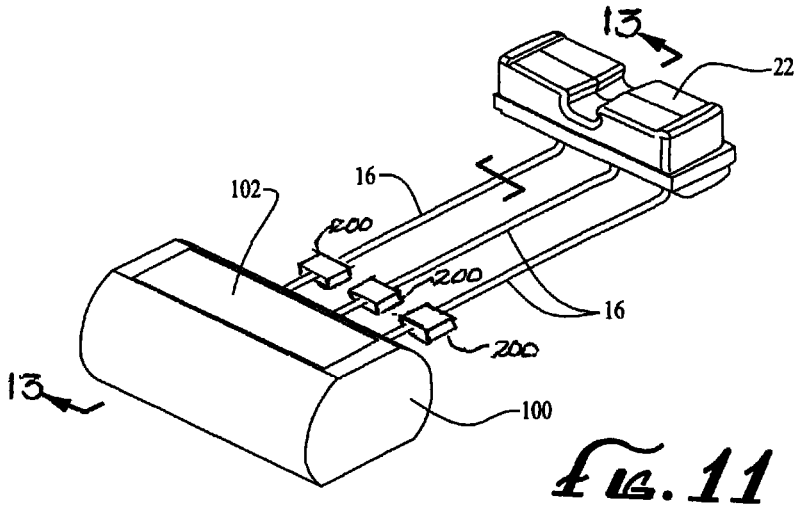
FIG. 11 is a schematic representation of an assembly comprising an artificial log as shown in the prior Figures connected to a fuel supply reservoir.
Figure 12:
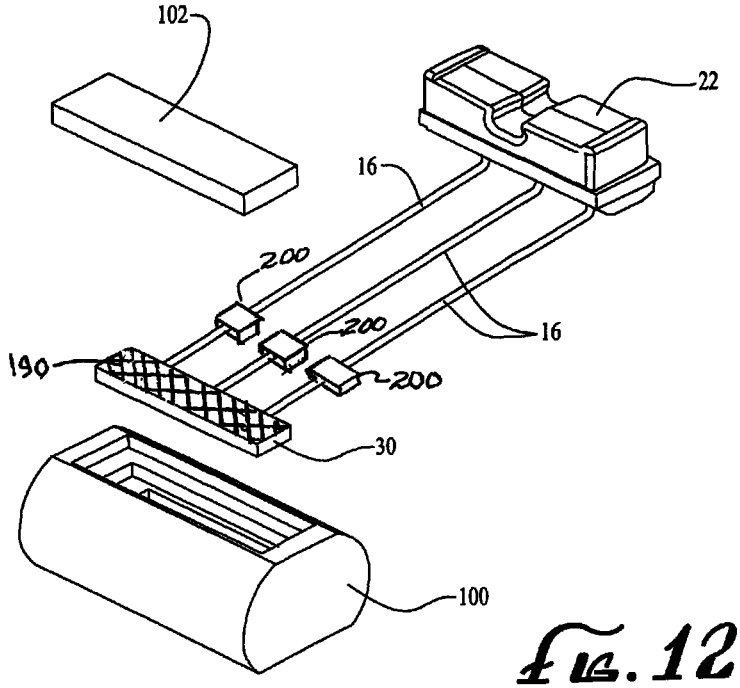
FIG. 12 is an expanded schematic view of the assembly of FIG. 11.
Figure 13:
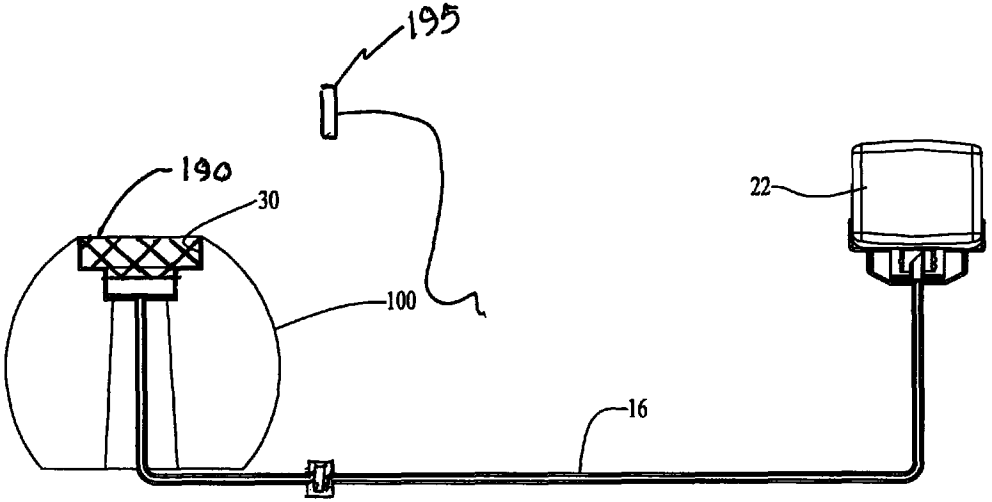
FIG. 13 is a cross sectional view taken along line 13-13 of FIG. 11.
Figure 14:
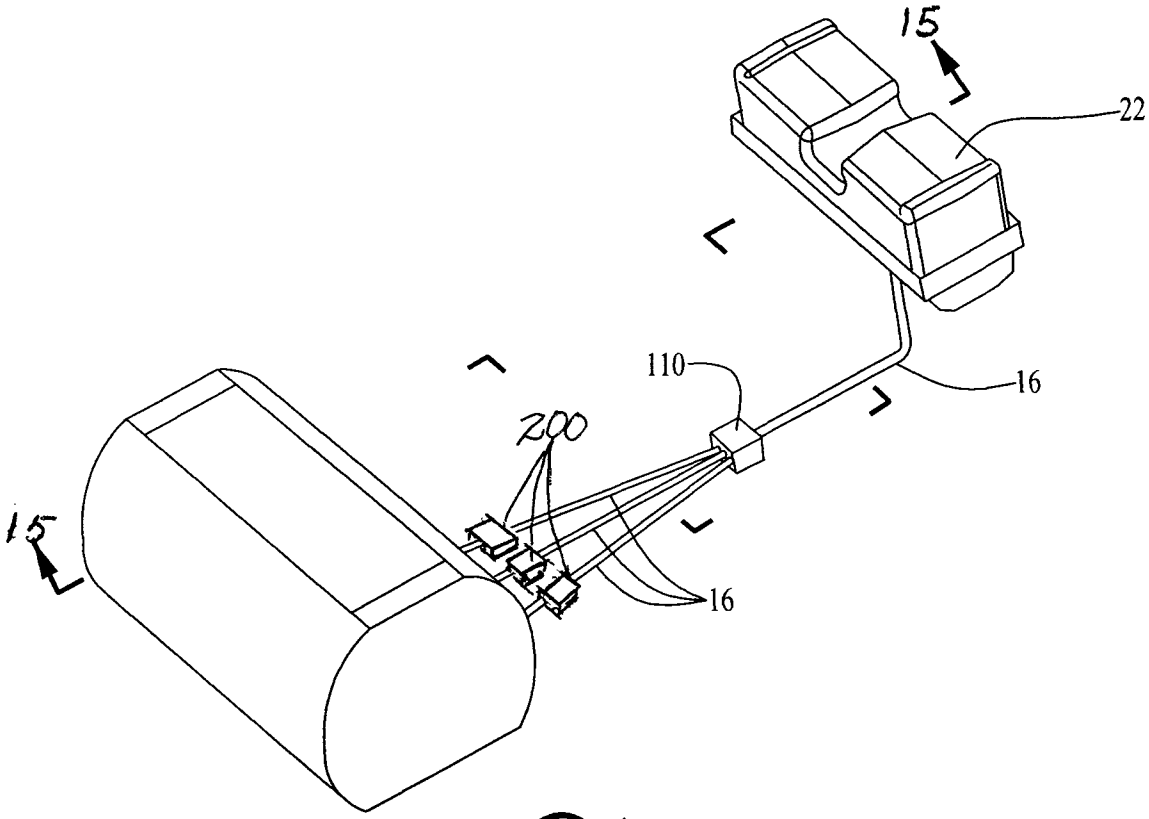
FIG. 14 is an alternative embodiment of the assembly of FIG. 11.
Figure 15:
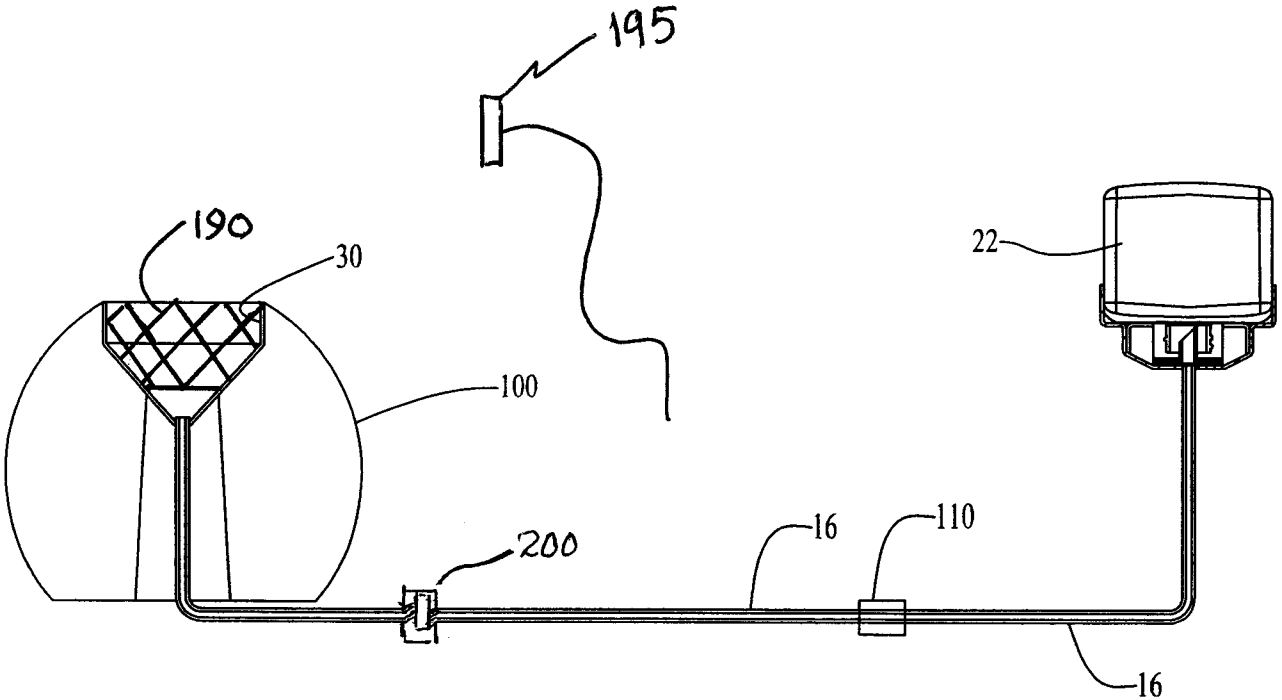
FIG. 15 is a cross sectional view taken along line 15-15 of FIG. 14.

FIG. 11, the expanded view of FIG. 12 and the cross sectional side view of FIG. 13, show a bottle 22 containing a combustible liquid (a fuel) with three conduits 16 for transmitting the combustible liquid between the bottle and the burner tray 30, which can also include the porous non-combustible material 190, the flame sensor 195, and flow controllers 200 located in the flow conduits. FIGS. 14 and 15 show a variation with a single conduit 16 connected to the bottle 22. Fluid in the single conduit 16 enters a flow splitter 110 which distributes the fluid into several conduits 16, each of which includes a flow controller 200 for feeding the burner tray and porous non-combustible material 190. While three conduits 16 are shown exiting the splitter 110, any number of conduits 16 can be used to feed the burner tray 30 and, in the alternative, as shown in FIG. 10 the conduits 16 can each feed separate burners. In a system that has at least two feed lines leading to at least two burn areas/trays, the control system could be randomized so that it allows for one flame to be growing and the other decreasing in size to create a more realistic effects like a real wood fire.

The rate at which the flame increases or decreases is dependent on a number of factors including but not limited to a) porosity of the porous material inside the trays; b) the distance from the tray fuel entrance point to the surface of the porous material where the fuel vapors burns; c) the pressure in the fuel line at the entrance to the tray; and d) other fuel characteristics like surface tension, ability to wet the porous material, etc.

Based on the teachings herein multiple alternative arrangements can be assembled to receive one or more bottles of liquid fuel in one or more locations, and then distribute that liquid fuel to one or more burners located between, adjacent to on or in artificial logs or burner trays or located at a distance from the burner trays or flame display and the porous non-combustible material 190 in those burners. Each conduit can include a flow regulator such as a valve, a pump or a combination thereof which have a preset feed rate, on-off controls, a variable feed rate or a remotely controlled feed rate, in a manner that that allows the fuel feed rate to each of the burner locations to be varied in a controlled or random manner while the flame is burning on the porous non-combustible material 190 surface, in one or more burners located adjacent, between the logs or on or in the logs or through alternative fire beds such as particulate materials such as, but not limited to, coal beds, bricks, glass pieces, or any other aesthetically desirable objects distributed in or across a burner.

I claim:

1. An improved assembly for creating a fire display from a liquid fuel comprising a burner tray and a non-combustible structure:

one or more fuel sources containing a liquid fuel, said fuel sources not located within the fire display structure, connected to one or more burner trays by one or more tubular flow conduits, said flow conduits providing fluid flow channels to transfer the liquid fuel from said one or more fuel sources to said one or more burner trays in the fire display assembly, the one or more burner trays within or adjacent the non-combustible structure or containing one or more non-combustible structures, said liquid fuel when ignited providing a flame above or adjacent exposed surfaces of the one or more non-combustible structures, the improvement comprising:

the one or more liquid fuel sources being replaceable and located at a distance from the flame to allow replacing the liquid fuel source while a flame is present while preventing ignition of the liquid fuel at the fuel source, the one or more conduits having a flow controlling mechanism located therein to control the transfer of the liquid fuel from the one or more replaceable fuel sources to the one or more burner trays through the one or more of the tubular conduits, said flow controlling mechanism configured to vary the rate of liquid fuel flowing therethrough which, in turn, increases or reduces the amount of liquid fuel in the burner tray causing a delayed change in the size of the flame emanating from the non-combustible structures or adjacent the non-combustible structures to be increased or reduced over an extended period of time without extinguishing the flame, and further including a flame sensor, said flame sensor operatively connected to the flow controlling mechanism so as to provide a controlled liquid fuel feed in response to changes in height of said flame.

2. The improved assembly of claim 1 wherein the flow controlling mechanism is a valve, the flow of the liquid fuel there through being manually or automatically controlled so as to provide a random or a predetermined liquid fuel flow rate over a present period of time.

3. The improved assembly of claim 1 wherein the flow controlling mechanism is a pump, the flow of the liquid fuel there through being manually or automatically controlled so as to provide a random or a predetermined flow rate over a period of time.

4. The improved assembly of claim 1 wherein a porous non-combustible material is provided to wick the fuel in the burner tray, said wicked fuel providing fuel fumes emanating from surfaces of said porous non-combustible material, said fumes when ignited providing the flame display.

5. The improved assembly of claim 1 for creating a fire display wherein said fire display provides the appearance of a natural log fire.

6. The improved assembly of claim 1 for creating a fire display wherein multiple fuel sources are provided to feed liquid fuel to a single burner tray in the flame display system.

7. The improved assembly of claim 1 for creating a fire display wherein multiple fuel sources are provided to feed liquid fuel to multiple burner trays in the flame display system.

8. The improved assembly of claim 1 for creating a fire display wherein multiple fuel sources are provided to feed liquid fuel to burner trays in multiple flame display systems.

9. The improved assembly of claim 1 for creating a fire display wherein a single fuel sources is provided to feed liquid fuel to burner trays in multiple flame display systems.

10. One or more burner trays, a porous non-combustible material positioned in the burner trays, the burner trays located on, in or adjacent one or more non-combustible structures, the one or more burner trays, porous non-combustible material and non-combustible structure constituting a fire display, and one or more replaceable sources containing a liquid fuel, the sources positioned at a location spaced a sufficient distance from said fire display to prevent ignition of said liquid fuel at the source while a fire display is present, one or more conduits connecting the replaceable liquid fuel sources to the burner trays, one or more of the conduits having a variable liquid flow control apparatus and a controller operatively connected to the variable control apparatus so as to control the flow of fuel there-through over a period of time in a preset manner or a controlled manner, wherein once the liquid fuel that is wicked into the porous non-combustible material is ignited, reducing or increasing the amount of fuel delivered through the adjustable feed assembly results in a delayed variation of the flame height without extinguishing the flame, and wherein a sensor is provided in a position to observe the height of the flame, the sensor operatively connected to an adjustable valve so as to adjust the liquid fuel flow rate to increase or decrease the flame height.

11. The fire display of claim 10 providing the appearance of a natural log fire.

12. A method of providing a controlled height, continuously burning liquid fuel flame comprising:

a) providing 1) one or more replaceable liquid fuel sources, 2) one or more fuel receiving burner trays connected to and located at a distance from the one or more replaceable liquid fuel sources by one or more conduits, the conduits providing a flow channel from said replaceable liquid fuel sources to said burner trays the one or more burner trays positioned under, partially under or adjacent to or within one or more non-combustible structures, the burner trays and non-combustible structure constituting a flame display, said distance being sufficient to prevent ignition by the flame of the fuel at the flame source, 3) one or more of said conduits having therein a variable flow controller to control the amount of liquid fuel flowing from the liquid fuel source to the burner tray, and b) varying the liquid fuel flow through one or more of the conduits without extinguishing said flame by using the variable flow controllers so as to lessen or increase the size of the flame emanating from one or more of the porous non-combustible material non-combustible structures over an extended period of time, and c) wherein a sensor is provided in a position to observe the height of the flame, the sensor operatively connected to an adjustable valve so as to adjust the liquid fuel flow rate to increase or decrease the flame height.

13. The method of claim 12 wherein the variable flow controller is an adjustable valve which can be manually controlled so as to control the fluid flowing there through.

14. The method of claim 12 wherein the variable flow controller is a variable speed pump which can be manually controlled or is operatively connected to a pump controller so as to vary the pump rate and in turn control the liquid flowing through the pump.

15. The improved assembly of claim 12 wherein a porous non-combustible material is provided to wick the fuel in the burner tray, said wicked fuel providing fuel fumes emanating from surfaces of said porous non-combustible material, said fumes when ignited providing the flame display.

* * * * *